United States Patent [19]

Armstrong et al.

[11] Patent Number: 4,553,633

[45] Date of Patent: Nov. 19, 1985

[54] SAFETY HARNESS SYSTEM FOR CONFINED SPACE WORKERS

[76] Inventors: Timothy J. Armstrong, 15 Lisa Ct., Hamilton, Ontario, Canada, L8V 4P9; Gerrard A. Wynen, 646 Maple Ave., Burlington, Ontario, Canada, L7S 1M6

[21] Appl. No.: 640,650

[22] Filed: Aug. 13, 1984

[51] Int. Cl.[4] ..... A62B 1/06; A62B 35/00

[52] U.S. Cl. ..... 182/3; 119/96

[58] Field of Search ..... 182/3, 4, 5, 6, 7, 8, 182/142; 119/96; 244/151 R

[56] References Cited

U.S. PATENT DOCUMENTS

| | | | |
|---|---|---|---|
| 2,699,284 | 1/1955 | Rose | 182/3 |
| 3,701,395 | 10/1972 | Theobald | 182/3 |
| 3,869,021 | 3/1975 | Sutherland | 182/3 |
| 4,076,101 | 2/1978 | Himmelrich | 182/3 |
| 4,273,215 | 6/1981 | Leggett | 182/3 |
| 4,308,629 | 1/1982 | Freemon | 182/3 |

*Primary Examiner*—Reinaldo P. Machado
*Attorney, Agent, or Firm*—Ridout & Maybee

[57] ABSTRACT

A safety harness for workers employed in confined space work such as entry to manholes is derived from a mountaineer's harness enhanced to provide improved functionality in this specialized application. Additional neck and crotch straps decrease the hazards involved to a topside worker in protecting a descending worker entering a confined space, and facilitate extraction of the descending work from the space in the event of an emergency. The harness incorporates fluorescent striping visible regardless of the position of a worker thus eliminating the need for a separate safety vest, and the addition of a pulley reduces the effort required to extract the descending worker from a confined space in an emergency.

4 Claims, 3 Drawing Figures

SAFETY HARNESS SYSTEM FOR CONFINED SPACE WORKERS

FIELD OF THE INVENTION

This invention relates to safety equipment for use by persons obliged to work in confined spaces, i.e., a space having limited access in which because of its construction, location, the activity conducted therein, accumulations of hazardous gases, dust or vapours, the creation of an oxygen deficient atmosphere, or other hazardous conditions may occur. Typical examples of confined spaces are sewers and other underground cavities having manhole access, inadequately ventilated excavations, and restricted spaces above ground having limited access and presenting a potential hazard for one reason or another to a worker obliged to operate in the space. Particularly in the case of manholes, associated workers outside the confined space may also be at risk through inadequate protection from hazards such as road traffic.

BACKGROUND OF THE INVENTION AND INFORMATION DISCLOSURE STATEMENT

Various operating procedures have been developed to reduce the hazards to workers operating in and around confined spaces. The state of the art is believed represented by the system developed by American Digital Systems, Inc. and described in detail in "ADS Field Safety Manual" by Barbara L. O'Brien, published by American Digital Systems, Inc., the text of which manual is incorporated herein by reference.

A major part of the safety equipment used in procedures described in the manual is constituted by certain well known items of mountaineering equipment including in particular mountaineer's harness, referred to in the manual as "climbing sit harness". A typical example of such harness is manufactured under the trade mark TROLL by the business of that name in Oldham, England. Although such harness serves quite well in the ADS system, it was designed for use in a rather different environment and to protect the wearer against somewhat different hazards.

Confined space work normally requires use of a two man (minimum) team, including a topside worker and a descending worker who actually enters the confined space. The duties of the topside worker include supervising the entry of the descending worker into the confined space, and breaking any accidental fall of the descending worker during entry or exit, securing the descending worker to a safe anchorage once the work zone has been reached, maintaining communication and visual contact with the descending worker, and extracting the descending worker from the confined space in the event of the latter suffering an accident or being overcome by fumes or lack of oxygen. The topside worker will often also be working in a hazardous location such as the middle of a highway. The known harness, whilst being well adapted, when sufficiently robustly constructed to stand up to continuous industrial rather than occasional recreational use, to facilitate the safety procedures required of the descending worker, is less than ideal from the point of view of the topside worker.

SUMMARY OF THE INVENTION

We have found that by making certain additions to the known mountaineering harness its utility in confined space work can be greatly increased.

According to the invention, a safety body harness for use by workers operating in confined spaces comprises a harness strap extending when in use past a junction of a first end loop in front of and somewhat to a first side of a user's chest, descending downwardly and around said first side of the user's body, through the user's crotch from the rear, up and around the hip on said first side of the body through a cross connection with the strap descending on said one side of the body, across the back and over the shoulder on the other side of the body past a second end loop somewhat to the other side of the user's chest, round the other side of the user's body, through the crotch from the rear, up and around the other hip through a cross connection with the strap descending on the other side of the body, across the back in the other direction and over the shoulder on the first side of the body to the junction with the first end loop, a chest strap surrounding the user's body when in use, and connected to the harness strap at its points of intersection with the latter, and a seat strap connecting portions of the harness strap passing beneath the buttocks of the user; the harness being improved by the addition of a first additional cross strap connecting portions of the harness strap in front of the crotch of the user; and a second additional cross strap connecting portions of the harness strap behind the neck of the user. Certain parts of the harness, especially the portions extending over the user's shoulders and the second additional strap are formed of fluorescent coloured webbing.

Further features of the invention and the significance of the above features will become apparent from the following description of a preferred embodiment of the invention.

DESCRIPTION OF THE PREFERRED EMBODIMENT

Figure 1:
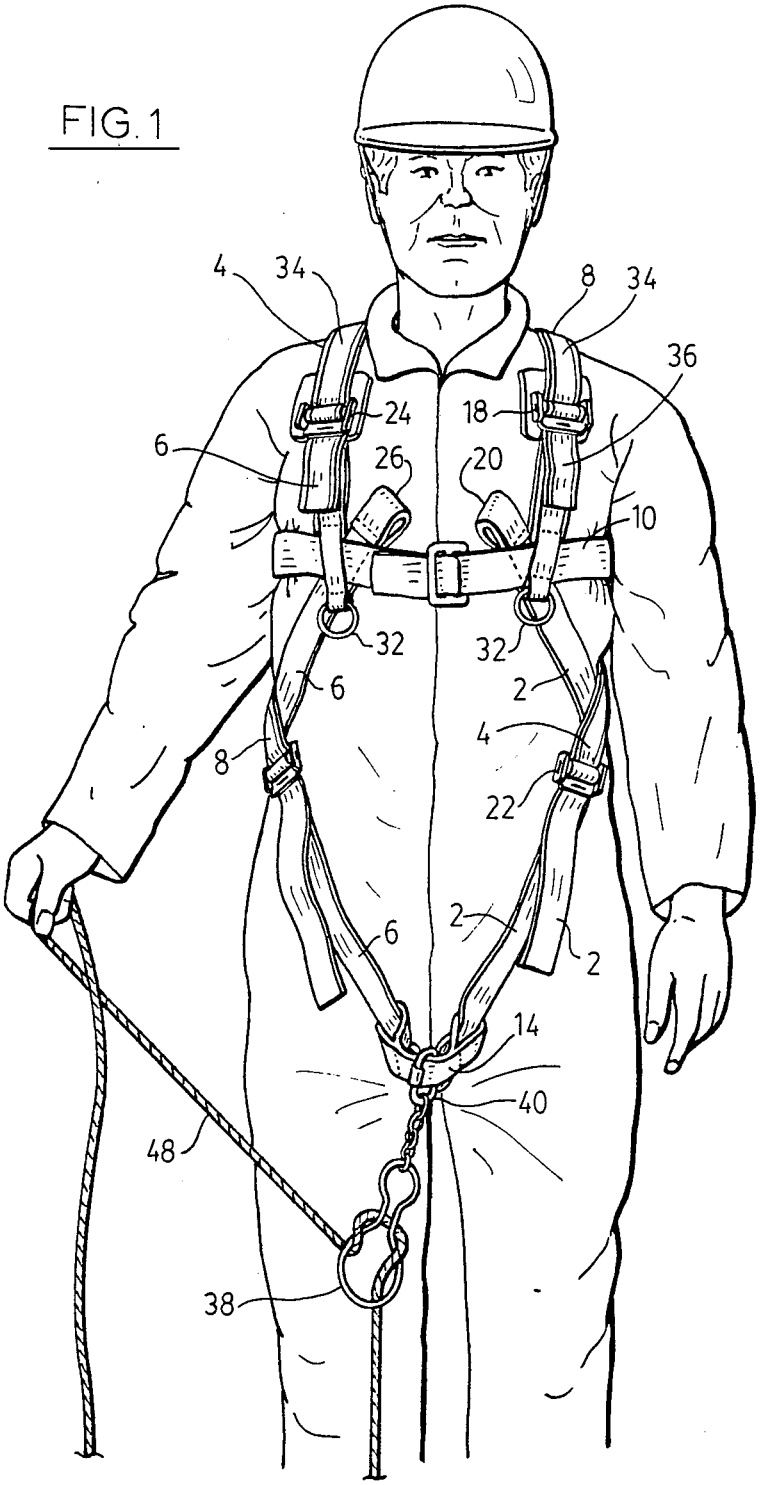
FIG. 1 is a front view of a topside worker using the harness of the invention.
Figure 2:
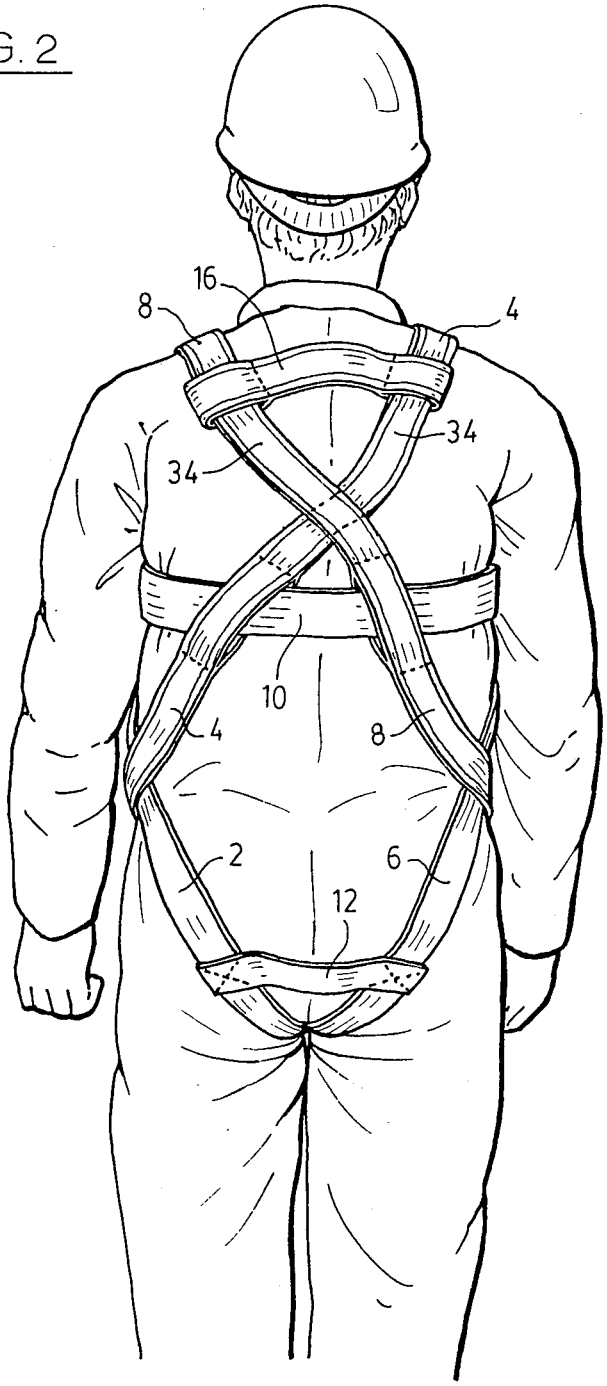
FIG. 2 is a corresponding rear view of the same worker.
Figure 3:
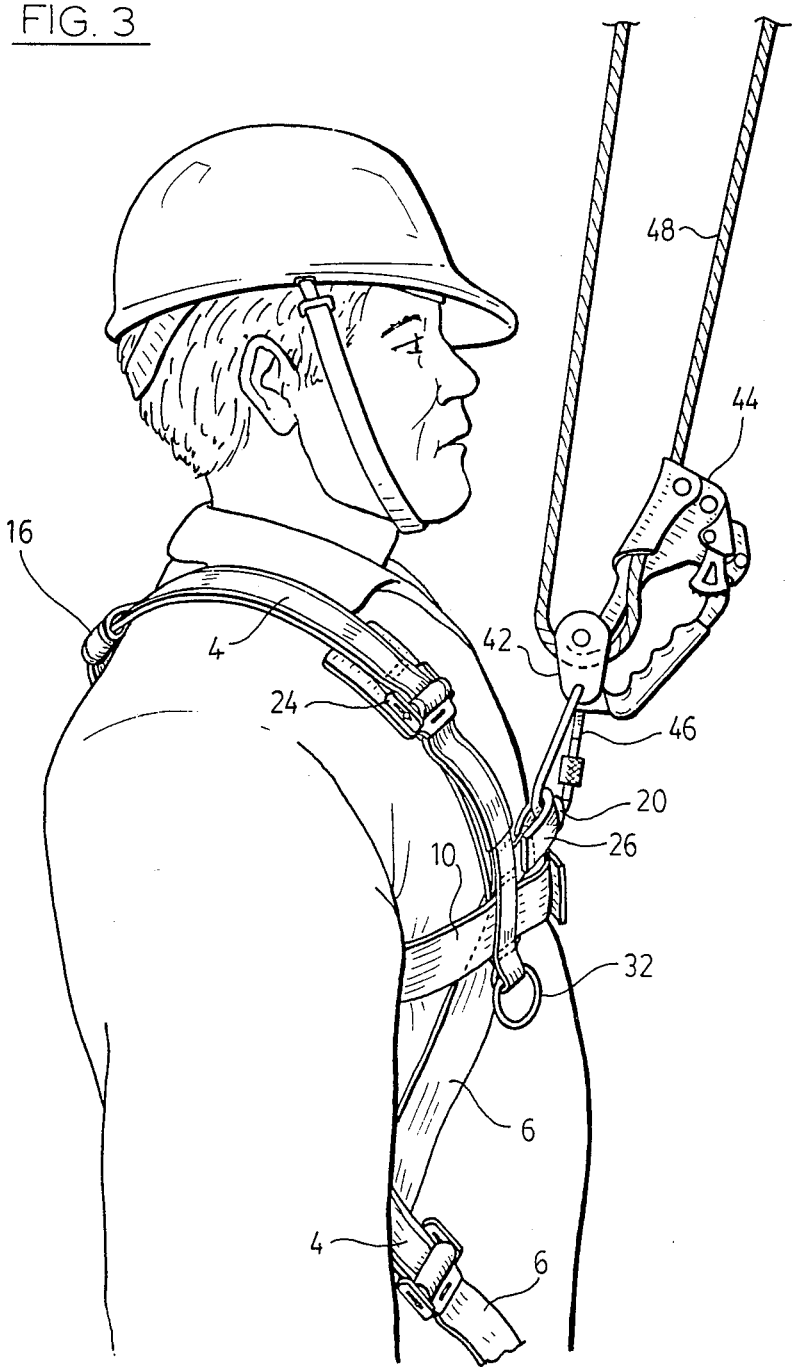
FIG. 3 is a side view of a descending worker using the harness.

Referring to the drawings, the harness consists of eight main webbing strap portions 2, 4, 6, 8, 10, 12, 14 and 16 (as opposed to six main portions in the conventional harness) and associated attachments and fittings. The strap portions 2, 4, 6 and 8 are connected end to end by buckles to provide in use a continuous strap of which the portion 2 extends from a buckle 18 in front of the left shoulder, past a junction with a terminal loop 20 which projects upwardly and inwardly in front of the left breast, then downwardly and rearwardly over the left hip, forwardly through the crotch, and upwardly and outwardly in front of the left hip to a buckle 22 joining the portion 2 end to end to the portion 4. The portion 4 extends upwardly and rearwardly and then upwardly across the back and over the right shoulder to a buckle 24 connecting it end to end to the portion 6. The portion 6 extends, past a junction with a terminal loop 26 which projects inwardly and upwardly over the right breast, downwardly and rearwardly over the right hip, forwardly through the crotch, and upwardly and outwardly in front of the right hip to a buckle 28 joining the portion 6 end to end to the portion 8. The portion 8 extends upwardly and rearwardly and then upwardly across the back, and over the left shoulder to the buckle 18 connecting it end to end with the strap 2. Each buckle 18, 22, 24 28 is secured to the strap portion having the downwardly extending end, with the upwardly extending strap end portion looping through tne buckle with its free end depending downwardly in front of the upwardly extending portion.

The strap 10 is joined end to end by a buckle 30 around the chest of the user and is connected by running loops to each of the straps 2 through 8 at its points of intersection therewith. The strap 12 connects the straps 2 and 6 beneath the buttocks of the user, enabling the latter to sit comfortably in the harness if necessary with the weight of the body supported on the buttocks and transferred through the straps 2 through 8, the straps 2 and 4 and 6 and 8 being connected at their intersections over the left and right hips respectively.

Additional straps with end rings 32 are attached to the upper ends of straps 2 and 6 for the suspension of equipment needed by a descending worker.

Thus far the features described are exhibited by known mountaineer's harness. In order to render the harness more suitable for confined space work, the two additional strap portions 14 and 16 are added. The strap 14 connects the straps 2 and 6 in front of the crotch of the user, and the strap 16 connects the straps 4 and 8 behind the neck of the user. The addition of these two straps greatly enhances the utility of the harness in the presently contemplated application.

The straps 4, 8 and 16 are formed of a fluorescent orange material which carries, at least on its outer surface, a reflective yellow stripe 34. A similar stripe 36 is incorporated on those portions of the straps 2 and 6 above the junctions with the loops 20 and 26, so that the loose ends of these straps projecting from the buckles 18 and 24 will exhibit fluorescent yellow stripes. The application of stripes as described ensures that at least part of the stripes should be visible, regardless of the position of the wearer of the harness. The buckles 18 and 24 function as, or include, protective shoulder pads.

In use, a harness as described above is worn by both the topside and descending worker. It will be noted that, even with the additions described, there are no buckles or other uncomfortable projections to the rear of the worker, and no intersections of straps occur where they will cause uncomfortable pressure when the wearer is sitting in a seat. The harness may therefore be comfortably worn during transit to a work site and during breaks. Moreover, the reflective stripes provided by the straps 2, 4, 6 and 8 and 16 as described above mean that no separate safety jacket is required, thus further enhancing the acceptability of the harness. If local regulations require it, additional fluorescent panels may be added to the harness.

The topside worker secures a figure-of-8 rappel 38 to the crotch strap 14 by means of locking carabiner 40, whilst the descending working attached a split pulley 42 and an ascender 44 to the terminal loops 20 and 26 by means of a carabiner 46. The figure-of-8 rappel, ascender and carabiners are all conventional mountaineering gear and their constructions and principles of operation are not thought to need further description.

The descending worker passes one end of a climbing rope 48 over the pulley 42 and the topside worker threads this end of the rope through the figure-of-8 rappel 38 in conventional fashion. The topside worker secures the other end of the rope to a suitable anchorage. When working on a highway or in any other location where accidental vehicle impact could occur, the anchorage should not be liable to violent movement in the event of a vehicle impact. Thus the rope should not be tied to a vehicle. Looping the rope around the "footprint" of the tire of a vehicle wheel is satisfactory, since the rope will then be left behind if the vehicle moves or is driven away.

Before the descending worker enters the confined space, typically through a manhole, the topside worker takes up the slack in the ropes between his rappel 38, the pulley 42 and the anchorage. As the descending worker moves into the confined space, he allows the rope to run through the rappel as shown in FIG. 1, but in the event of a fall by the descending worker the movement of the rope can be arrested by pulling on the rope. If no other means for descent is availabie, the rappel may be used to provide controlled lowering of the descending worker whose weight is sustained by his harness. In the event of mishap, the loadings of the rope are transferred to the topside worker's harness through the strap 14 at a point which ensures they are well distributed and minimizes the risk of the topside worker being pulled off balance. On arrival at the work site, the descending worker secures the rope by locking the ascender 44 to the upper run of the rope extending towards the anchorage. At this point the other "live" run of the rope may be unthreaded by the topside worker from the rappel 38, but a further ascender should be at hand or applied to the rope should it be necessary to assist the descending worker to leave the confined space. The topside worker maintains observation of the descending worker, assisted by the reflective stripes 34, 36. Should an emergency exit from the confined space be necessary in the event of actual or potential incapacitation of the descending worker, the live run of the rope may be hauled in by the topside worker with the aid of the second ascender. As the rope is pulled over the pulley 42, it will run through the ascender 44, but between pulls, the ascender 44 will grip the rope and prevent reverse movement. This action, combined with the mechanical advantage provided by the pulley, enables the topside worker to readily haul in the descending worker to an accessible position without having to sustain the descending worker's weight continuously.

Once the descending worker reaches an accessible position, for example in a manhole opening, the strap 16 on his harness provides a purchase by which the topside worker may complete his extraction from the confined space, with the assistance of the strap 12 when this becomes accessible. The strap 16 also assists in keeping the head of an unconscious worker thrown forward where it is less susceptible to injury during withdrawal.

It will of course be understood that the procedures described above constitute only those parts of the safety procedures employed in confined space work, which are directly related to use of the harness. It should also be understood that components such as rappels, carabiners and ascenders may be replaced by their functional equivalents although it is believed advantageous to use conventional components whose reliability and functionality have been tested and refined over many years.

We claim:

1. In a safety body harness for use by workers operating in confined spaces comprising:

a harness strap extending when in use past a junction of a first end loop in front of and somewhat to a first side of a user's chest, descending downwardly and around said first side of the user's body, through the user's crotch from the rear, up and around the hip on said first side of the body through a cross connection with the strap descending on said one side of the body, across the back and over the shoulder on the other side of the body past a second end loop somewhat to the other side of the user's chest, round the other side of the user's body, through the crotch from the rear, up and around the other hip through a cross connection with the strap descending on the other side of the body, across the back in the other direction and over the shoulder on the first side of the body to the junction with the first end loop, a chest strap surrounding the user's body when in use, and connected to the harness strap at its points of intersection with the latter, and a seat strap connecting portions of the harness strap passing beneath the buttocks of the user;

the improvement comprising:

a first additional cross strap connecting portions of the harness strap in front of the crotch of the user; and a second additional cross strap connecting portions of the harness strap behind the neck of the user.

2. A harness according to claim 1, wherein said harness strap is formed in four portions connected by adjusting buckles so as to fit the harness to the user, the adjusting buckle being located so as to be positioned in front of and beneather the shoulders and in front of the hips of the wearer with free ends of the strap portions depending downwardly from the buckles so as to be available for adjustment, at least the strap portions extending over the user's shoulders being of fluorescent coloured webbing whereby to ensure that at least a portion of the fluorescent webbing will be visible regardless of the position of the user.

3. A harness according to claim 2, wherein the second additional cross strap is also of fluorescent coloured webbing.

4. Safety equipment for crews working in confined spaces comprising:

at least two harnesses according to claim 1, at least one split pulley;

at least two mountaineers' ascenders;

at least two carabiners, at least one figure-of-8 rappel; and at least one climbing rope.

* * * * *